US005088304A

United States Patent [19]

Schlichtig

[11] Patent Number: 5,088,304

[45] Date of Patent: Feb. 18, 1992

[54] HEAT TRANSFER SYSTEM WITH RECOVERY MEANS

[76] Inventor: Ralph C. Schlichtig, 11212 Third Ave. S., Seattle, Wash. 98168

[21] Appl. No.: 598,836

[22] Filed: Oct. 15, 1990

[51] Int. Cl.[5] ..... F25B 1/10

[52] U.S. Cl. ..... 62/510; 418/15; 418/191

[58] Field of Search ..... 62/510, 119, 509, 512; 418/15, 191, 227

[56] References Cited

U.S. PATENT DOCUMENTS 4,059,968 11/1977 Ross ..... 62/510

4,745,777 5/1988 Morishita et al. ..... 62/510

*Primary Examiner*—Henry A. Bennet

*Assistant Examiner*—John Sollecito

[57] ABSTRACT

A heat transfer system employing a two-stage compressor and a heat recovery system including a flash vapor receiver which pools warm refrigerant from a system condenser, delivering receiver refrigerant vapor to the compressor at its second stage inlet and delivering receiver liquid refrigerant to a system evaporator. The system also employs evaporation, compression and condensation of an oilless refrigerant, or an azeotrope mixture of oilless refrigerants, to reduce compression and resulting power requirements. The system evaporator or evaporators are flooded with refrigerant, with vaporous refrigerant separated and routed to the compressor and liquid refrigerant separated and returned to the evaporators.

4 Claims, 5 Drawing Sheets

HEAT TRANSFER SYSTEM

REFRIGERANT R-134

HEAT TRANSFER SYSTEM WITH RECOVERY MEANS

This invention relates generally to mechanically driven heat transfer systems that may function as a refrigerator, as a heat pump for heating building spaces, or as an air conditioner. More specifically, the invention relates to oil-free heat transfer systems with secondary heat removal means for further removing heat from a system refrigerant between a system heat dissipator, typically a condenser, and a system heat source extractor, typically an evaporator.

It is known in the art to have heat pump systems typically comprising a system refrigerant, an evaporator for extracting heat from a local heat source by low pressure evaporation of the refrigerant, a compressor for increasing the pressure of the evaporated refrigerant, and a condenser for condensing the fluid refrigerant from vapor phase to liquid phase to cause the heat of vaporization to be released to the condenser environment.

It is known in heat pump systems that the evaporator internal surface must be wet for efficient transfer of heat from the local heat source through the evaporator to the refrigerant. It is also required, however, that refrigerant delivered to a system compressor must be fully in the gaseous phase. To assure that there is no liquid refrigerant, conventional systems use a regulating expansion valve on the input to the evaporator that constrains refrigerant temperature in the evaporator to be slightly above that required for total evaporation at the refrigerant pressure. In doing so, efficiency is compromised in that the refrigerant vapor pressure does not rise to the saturation level. Thus, refrigerant in the evaporator is fully evaporated, though with compromised efficiency.

Oil transporting refrigerants such as present Freon chloroflourocarbons contain chlorine. These chlorine refrigerants soon are likely to be disallowed due to the damage their release has been found to cause to the ozone in the planet's atmosphere. However, substitute flourocarbons without chlorine will not transport oil. Hence, prior art heat transfer systems generally will become inoperable.

Conventional heat pump systems typically deliver the vaporized refrigerant heat of vaporization, a phase change energy, at the condenser and leave most of the molecular heat as measured in refrigerant temperature in the resulting liquid refrigerant. This heat is effectively returned with the refrigerant to the system evaporator where the local heat source is intended to provide the energy to again evaporate the refrigerant. If the temperature of the refrigerant were lowered before returning to the evaporator, and the extracted heat were returned to the condenser, the system would be more efficient.

In increasing pressure between the evaporator and the condenser, compressors of conventional heat pump systems add energy to the system. In increasing pressure, it is characteristic of all gases to also increase in temperature. This added temperature, and the increased energy input it represents, is a burden on the system. It is advantageous for system efficiency to minimize this temperature increase. One approach is to use a refrigerant that is most ideal—that is, use a refrigerant that allows a low compression ratio between the evaporator and the condenser and whose vapor has a specific heat sufficient to avoid delivering superheated vapor to the condenser. Currently-used refrigerants R-12 and R-22 have specific heat values that are generally too small to prevent superheating.

It is known that the evaporator of conventional systems must be located in the vicinity of the compressor so that oil is able to be transported in the refrigerant between the two components. A secondary benefit in being able to use an oilless refrigerant is that the evaporator can be located remote from the compressor because there is no need to transport oil between them. A further benefit is that without oil in the refrigerant, no insulation film of oil coats the inside surface of the condenser, which would impede heat transfer.

OBJECTIVES OF THE INVENTION

A first object of the present invention is to increase system efficiency by extracting heat from the refrigerant liquid after it exits the condenser and before it enters the evaporator and by returning this heat to the condenser.

A second object of the present invention is to provide a heat pump system that is compatible with an oilless, chlorine-free refrigerant, including an oilless compressor.

A third object is to increase system efficiency by providing that the vapor pressure in the evaporator is allowed to reach saturation before exiting the evaporator.

A fourth object is to permit location of the evaporator remote from the compressor in order to expand the choices of possible heat sources for the evaporator.

A fifth object is to employ as the refrigerant a near azeotrope mixture of fluids that minimizes the compression ratio between the evaporator and the condenser and therefore the power comsumption in the compressor.

A final object is to minimize superheat in the refrigerant delivered by the compressor by employing a refrigerant or refrigerant mixture with sufficient specific heat of the vapor to eliminate superheat of the vapor entering the condenser.

SUMMARY OF THE INVENTION

A heat transfer system employing a two-stage compressor and a heat recovery system in which a flash vapor receiver is provided which pools a system refrigerant from a system condenser, delivering receiver refrigerant vapor to the compressor at its second input port and delivering receiver liquid refrigerant to a system evaporator. The compressor comprises a constant-volume second stage, achieving second-stage compression through input of vaporized refrigerant from the flash vapor receiver. The system also employs evaporation, compression and condensation of an oilless refrigerant, or an azeotrope mixture of oilless refrigerants, to reduce compression requirements. The system evaporator or evaporators are flooded with refrigerant with provision for vaporous refrigerant to be separated and routed to the compressor and liquid refrigerant to be separated and returned to the evaporators.

DESCRIPTIONS OF THE PREFERRED EMBODIMENTS

Figure 2A:
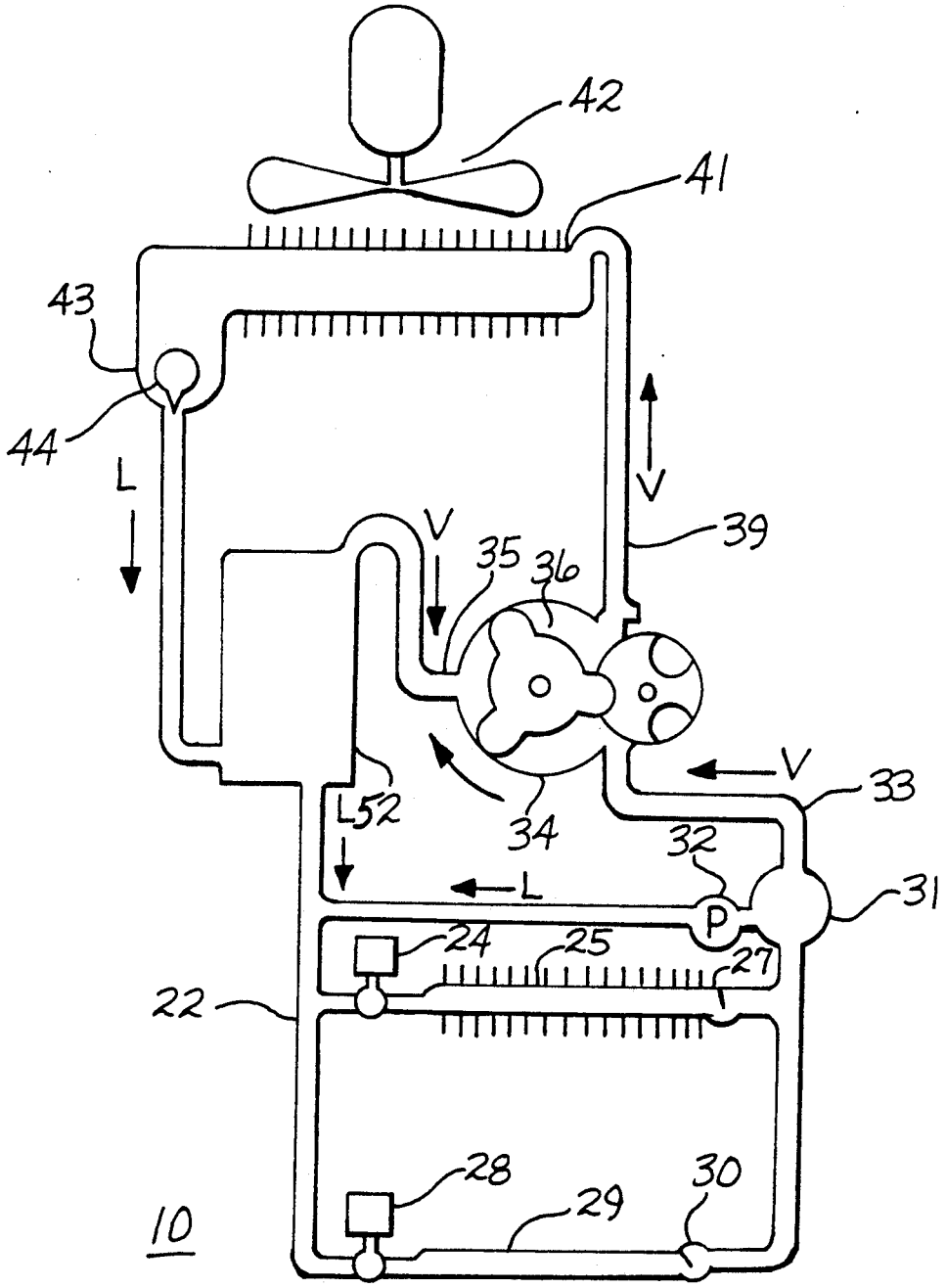
FIG. 2*a* shows an embodiment of the invention with two alternate evaporators, a two-stage rotary compressor with a constant volume between rotors at the second stage, condenser, and a flash vapor receiver intercepting a system fluid path between the condenser and the evaporators and connected to a second input port of the compressor for extracting excess fluid heat and routing receiver vapor containing the extracted heat to the compressor second input port, together with associated fans, valves and float chambers.

As shown in FIG. 2, typical of a convention heat pump system, heat transfer system 10 comprises elements connected generally in series, such that system oilless refrigerant liquid flows through a liquid supply duct 22 to a ground heat supply evaporator 29, or to an outdoor finned evaporator 25, or, in the preferred embodiment shown in FIG. 2*a*, to both a ground heat evaporator 29 and an alternate outdoor finned evaporator 25 connected in parallel but to be used alternately, depending on which is at the warmer temperature. Between the liquid supply duct 22 and each evaporator 25 and 29 is a solenoid valve 24 and 28, respectively, regulating refrigerant input to the respective evaporators. Evaporator check valves 27 and 30 at exit ends of evaporators 25 and 29, respectively, for preventing each respective evaporator from filling with liquid when not in use.

Unlike conventional systems with oilled refrigerants, in operation, an evaporator is flooded with refrigerant, thereby providing constant wetting of the inner surface of the evaporators 25 and 26 for maximum heat transfer from the environment through the evaporator to the refrigerant.

Refrigerant then passes to a residue separator 31 in fluid connection with the evaporator check valves 27 and 30. Liquid is allowed to separate in the residue separator 31 with the refrigerant vapor exhausting the separator 31 and entering compressor primary input port 33. Refrigerant liquid in the residue separator 31 is pumped by liquid pump 32, which is connected between the residue separator 31 and liquid supply duct 22 for recycling surplus liquid back through an evaporator.

Refrigerant vapor passes then to two-stage compressor 34. Compressed vapor is discharged from the compressor 34 through the compressor discharge duct 39 to finned condenser 41 with fan 42 adjacent thereto for directing air over the condenser as pressurized refrigerant vapor condenses, delivering its heat of vaporization to the condenser. Attached at a fluid exit end of the condenser 41 is float chamber 43 with liquid control float valve 44 which regulates liquid refrigerant return and prevents high pressure vapor from exhausting from the condenser.

It is known in the art that oil can be transmitted only a limited distance by refrigerant vapor. Hence, it is usual in conventional systems that system evaporators be located in near proximity to a system compressor, limiting the convenient availability of heat sources for system evaporators. The present invention does not require oil to be in the refrigerant for compressor lubrication, and thus the evaporator can be remote from the compressor.

Liquid and vapor leaving the evaporator are separated in the liquid separator 31 to assure that only vapor is transmitted to the compressor.

Unique to this invention is a vapor flash receiver 52 which intercepts refrigerant flow from condenser 41 and float chamber 43 from liquid control float valve 44 and before liquid supply duct 22. Liquid supply duct 22 is connected to receiver 52 so that liquid refrigerant in the receiver 52 passes to liquid supply duct 22. As shown in FIG. 2*a*, refrigerant vapor exhaust from the receiver plenum chamber is connected to a secondary input port 35 of compressor 34. Thus, refrigerant vapor which is precompressed from the heat of receiver 52 enters the compressor at an intermediate pressure to be mixed with and to compress refrigerant vapor received from a compressor primary input port 33. By providing a precompressed gas to the compressor 34, work required from compressor 34 is reduced and system efficiency is improved. To further improve system efficiency as shown in FIG. 2*a*, the system employs a rotary-lobe, two-stage compressor having a constant volume between adjacent lobes presented to a secondary input at the second stage. This constant volume second stage therefore achieves compression solely from its secondary input gas at pressure higher than gas input at a primary stage, eliminating work at the compressor secondary stage and eliminating back pressure inefficiencies at the secondary input incurred with multistage compressors providing mechanical compression at a second or higher stage.

Figure 2B:
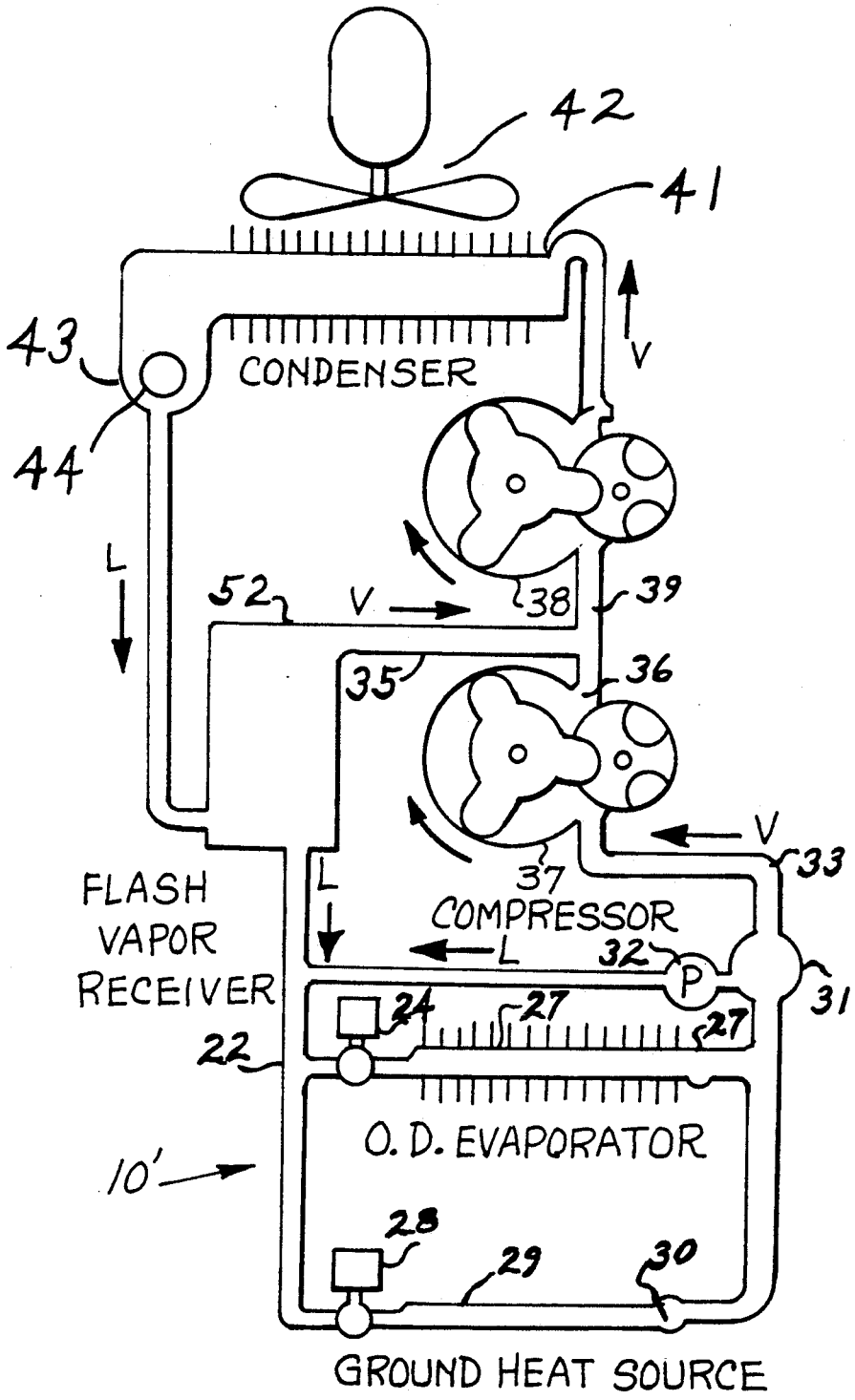
FIG. 2*b* shows an embodiment similar to FIG. 2*a* in which two separate single-stage compressors are employed instead of a single two-stage compressor.

In an alternative embodiment, shown in FIG. 2*b*, compressor 34 comprises two single stage compressors 37 and 38 in series with the vapor exhaust from the plenum chamber connected between the two compressors.

The heat transfer system 10 can function either as a heat pump for heating or as an air conditioner for cooling. As shown in alternative embodiment 20 illustrated in FIG. 3, to provide for air conditioning, an indoor finned evaporator 26 is substituted for an outdoor finned evaporator 25 and connected in in parallel with indoor finned condenser 41 with an associated float chamber 48 with float valve 49 similar to that of the indoor finned condenser 41, float chamber 43 and valve 44 with solenoid valves 40 and 46 respectively regulating the fluid input of the condensers and also with check valves 45 and 50 respectively constraining fluid movement from condenser float valves 44 and 49 to the flash vapor plenum chamber 21.

Figure 1:
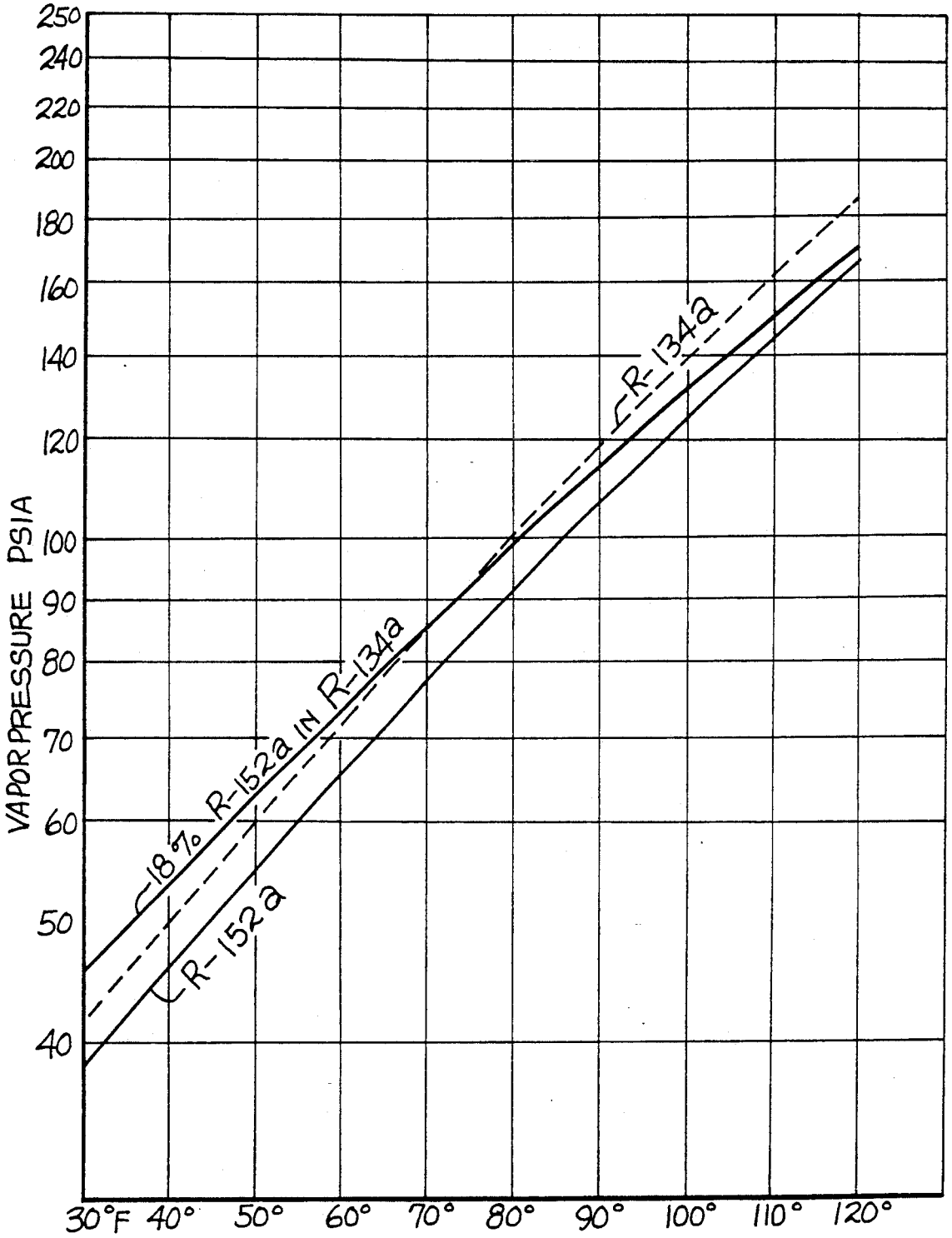
FIG. 1 shows a plot of vapor pressure versus temperature on a vertical logarithmic scale comparing refrigerants R-134*a*, R152*a* and a 18% mixture by weight of R-152*a* in R-134*a*.

As shown in FIG. 1, an azeotrope mixture of 18% by weight R-152*a* refrigerant in refrigerant R-134*a* produces a system refrigerant improved over either. Over the temperature range of 300° F. to 120° F., the ratio of pressure of refrigerant at 120° F. to that of 30° F. is less for the mixture than for either component. The lower compression ratio is beneficial to the system efficiency, first, because the power required in compressing the refrigerant in the compressor is reduced, and, second, because superheat in the refrigerant leaving the compressor is reduced.

Figure 3:
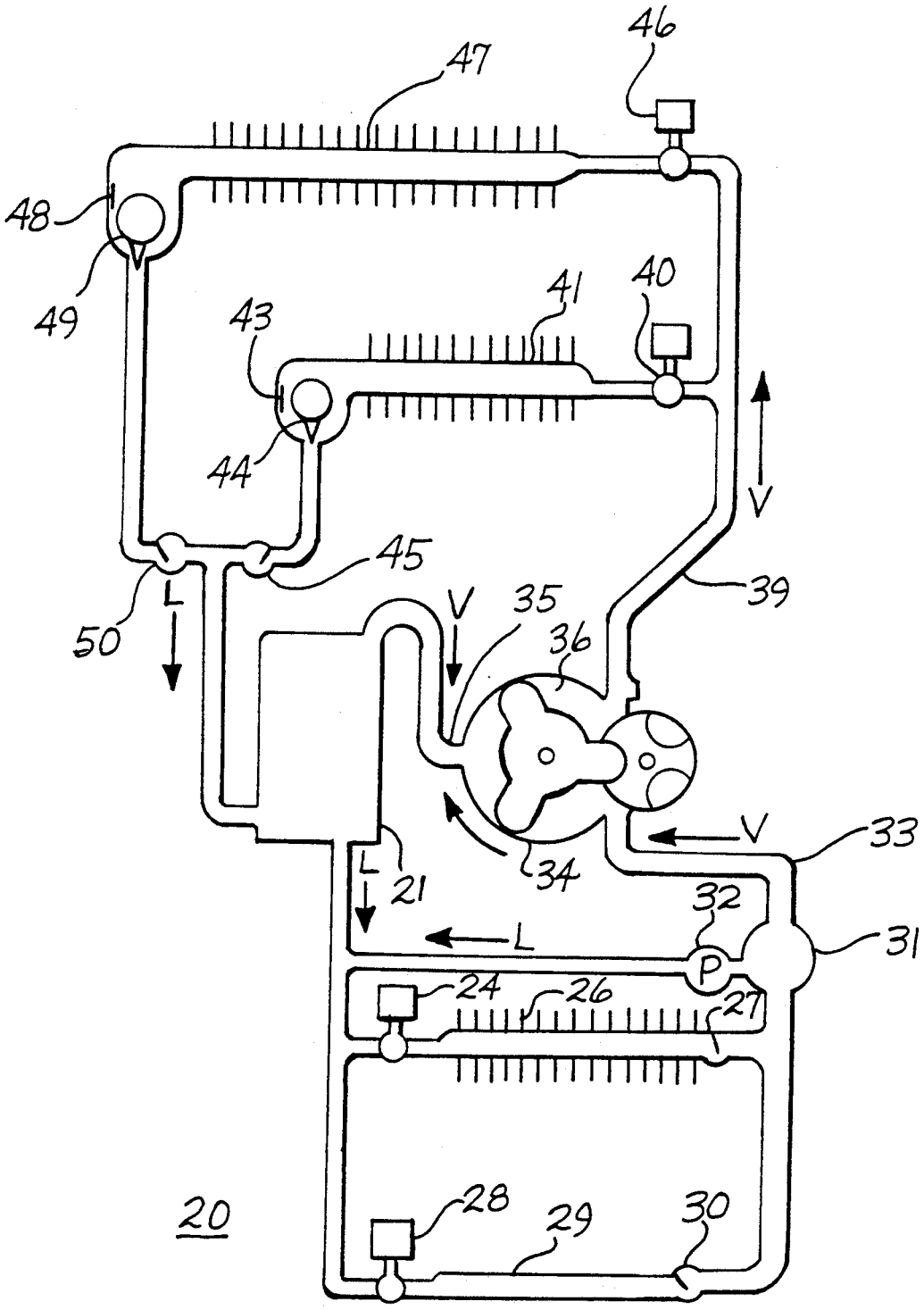
FIG. 3 shows an second embodiment of the invention additionally showing a second condenser in parallel with the condenser of FIG. 2 together with associated valves and float chambers.
Figure 4:
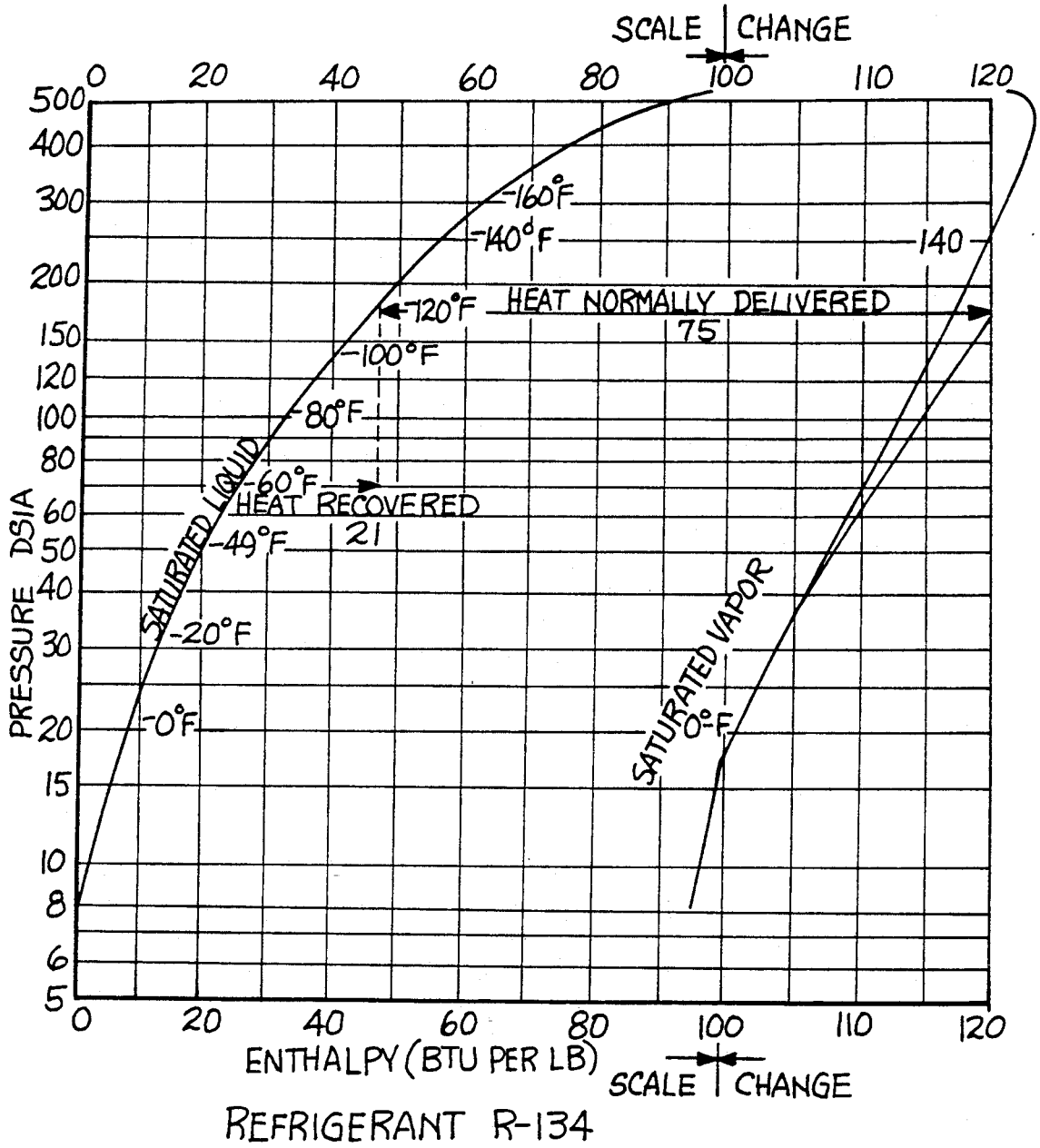
FIG. 4 illustrates performance characteristics of a cycle of a typical heat transfer system, illustrative for a system using one pound of refrigerant R-134*a* with input heat at temperature of 32 degrees Fahrenheit (° F.) and delivered heat at temperature of 120° F.

A further alternate embodiment of the present invention is shown in FIG. 3 as a second heat transfer system 20 useful either as a heat pump or as an air conditioning and cooling system. To obtain the second heat transfer system 20 from heat transfer system 10, an indoor finned evaporator 26 is substituted for the outdoor finned evaporator 25, an outdoor finned condenser 47 is added in parallel with indoor finned condenser 41, and indoor and outdoor solenoid valves 40 and 46, respectively, are inserted before the indoor and outdoor finned condensers 41 and 47. Outdoor float chamber 48 with indoor float valve 49 regulating release of liquid refrigerant from outdoor float chamber 48 in similar relation to the outdoor condenser 47 as are indoor float chamber 43 and indoor float valve 44 are to indoor condenser 41. Each of indoor float valve 44 and outdoor float valve 49 are then ducted together to provide common fluid communication to the flash vapor receiver 52. Check valves 45 and 50 are provided between the respective float valves 44 and 49 and common connection to the flash vapor chamber 52 to prevent undesirable refrigerant back flow to the respective float chambers.

What is claimed is:

1. A heat transfer system comprising an evaporator for receiving heat, a compressor in fluid connection with the evaporator for compressing refrigerant vapor from the evaporator, a condenser connected to receive compressed vapor refrigerant from the compressor for delivering heat, a liquid supply duct providing fluid connection between the evaporator and the condenser, and a system refrigerant flowing within the system, the improvement comprising in the compressor, a two-stage, rotary lobe compressor with a primary input port for receiving vaporized refrigerant and a secondary input port for receiving vaporized refrigerant at pressure greater than vapor received at the primary input port and three or more lobes in rotation, during which rotation lobes on each side of the secondary input port define and bound a constant compressor volume, therein providing for input of recovered refrigerant vapor and establishing a compressor second stage, and further comprising a flash vapor receiver between the condenser and the liquid supply duct for pooling warm refrigerant from the condenser assembly and fitted to deliver liquid refrigerant from the receiver to the liquid supply duct and further fitted to delivery vapor refrigerant from the receiver to the secondary input port of the compressor.

2. A heat transfer system as in claim 1 wherein the two-stage compressor comprises a separate first stage compressor and a second stage compressor in series connection in which the second stage compressor receives refrigerant vapor from both the first stage compressor and the flash vapor receiver.

3. A heat transfer system as in claim 1 wherein the condenser further comprises two condensers in parallel between the compresser and the flash vapor receiver and further comprising a control valve between each respective condenser and common fluid connection to the compressor for regulating fluid flow to the condensers.

4. A heat transfer system as in claim 1 in which the evaporator comprises two evaporators in parallel between the liquid supply duct and the separator, each with a control valve between the respective evaporator and common connection to the liquid supply duct for regulating refrigerant input to the respective evaporators and each also with a check valve for restricting refrigerant back flow into the respective evaporators.

* * * * *